United States Patent [19]

Magnusson

[11] 4,449,261

[45] May 22, 1984

[54] BED MATTRESS HAVING AN IMPROVED PILLOW TOP

[75] Inventor: Robert A. Magnusson, Atlanta, Ga.

[73] Assignee: Simmons U.S.A. Corp., Atlanta, Ga.

[21] Appl. No.: 275,955

[22] Filed: Jun. 22, 1981

[51] Int. Cl.[3] ..... A47C 23/04; A47C 27/05; A47C 27/14

[52] U.S. Cl. ..... 5/465; 5/470; 5/474

[58] Field of Search ..... 5/462, 464, 465, 470, 5/471, 474, 400, 451, 450, 421

[56] References Cited

U.S. PATENT DOCUMENTS

| | | | |
|---|---|---|---|
| 1,356,148 | 10/1920 | Hobert . | |
| 1,371,362 | 3/1921 | Giese | 5/474 |
| 1,375,061 | 4/1921 | Nyhus | 5/470 |
| 1,393,755 | 10/1921 | Conlan . | |
| 2,154,910 | 4/1939 | Magaril | 5/470 |
| 2,504,352 | 4/1950 | Robell . | |
| 2,651,788 | 9/1953 | Forwood | 5/470 |
| 3,166,768 | 1/1965 | Cunningham . | |
| 3,241,161 | 3/1966 | Dashosh | 5/501 |
| 3,287,749 | 11/1966 | Marsico | 5/470 |
| 3,493,980 | 2/1970 | Haller | 5/478 |
| 3,530,487 | 9/1970 | Beer | 5/496 |
| 3,534,417 | 10/1970 | Boyles | 5/462 |
| 3,837,021 | 9/1974 | Sellers et al. | 5/502 |
| 3,950,798 | 4/1976 | Borsini | 5/470 |
| 4,015,299 | 4/1977 | Tinnel | 5/451 |
| 4,162,393 | 7/1979 | Balboni | 5/421 |
| 4,224,706 | 9/1980 | Young et al. | 5/449 |
| 4,234,983 | 11/1980 | Stumpf | 5/477 |
| 4,234,984 | 11/1980 | Stumpf | 5/477 |
| 4,245,363 | 1/1981 | Callaway | 5/451 |
| 4,274,169 | 6/1981 | Standiford | 5/485 |

FOREIGN PATENT DOCUMENTS

| | | | |
|---|---|---|---|
| 555821 | 3/1957 | Belgium | 5/470 |
| 496756 | 4/1930 | Fed. Rep. of Germany | 5/474 |
| 1778736 | 8/1971 | Fed. Rep. of Germany | 5/462 |
| 2117333 | 9/1972 | Fed. Rep. of Germany . | |
| 1541071 | 2/1979 | United Kingdom | 5/450 |

*Primary Examiner*—Alexander Grosz

*Attorney, Agent, or Firm*—Scully, Scott, Murphy & Presser

[57] ABSTRACT

A mattress is provided having a continuous border portion having a removable and reversible pillow top fastened thereto. The border portion has a large cavity disposed therein to receptably receive a core mattress. Differing core mattresses can be inserted into the cavity to modify the degree of firmness of the overall mattress. The border portion is further internally provided with supporting means such as coil springs disposed therein. The reversible pillow top provides further versatility in providing a variety of sleeping surfaces.

18 Claims, 18 Drawing Figures

BED MATTRESS HAVING AN IMPROVED PILLOW TOP

BACKGROUND OF THE INVENTION

1. Field of the Invention

The present invention relates to a novel bed mattress and, more particularly, to a novel bed mattress having a cavity therein, within which numerous cores can be inserted to provide a wide range of firmness or softness or other support as may be desired and further which utilizes a reversible pillow top.

The present inventive arrangement provides a novel concept of providing a removable core within the inner portion of a mattress and a removable and reversible pillow top covering said core. As a result of the present invention, the core provides great flexibility to the user in that a variety of cores, i.e., firm and/or soft innersprings; fluid containing; pocketed coils; foam and the like can be inserted into the mattress to provide the desired sleeping system. Moreover, the reversible pillow top also offers additional versatility in providing the desired sleeping system. In other embodiments of the present invention, two or more cores having different degrees of firmness or comfort effects can be inserted into the inner portion thereof to provide differing degrees of firmness or support throughout the same bed. This flexibility allows the mattress to be fully adaptable to any who sleep or rest thereon. As a result, for example, in the case of two people, the preferences of both of the people can be fulfilled without the purchase of a separate bed. Moreover, the bed mattress of the present invention is further provided with a border or collar portion which provides the requisite stiffness necessary to retain the overall shape of the mattress, the border or collar portion preferably comprised of interconnected coil springs, extending throughout the continuous border or collar portion which, in turn, defines the inner portion of the mattress forming a cavity within the mattresss border.

2. Description of the Prior Art

The present state of the art related to bed mattresses has developed numerous mattresses which can be somehow modified in terms of softness or firmness to suit the particular desires of the consumer. It is well known in the prior art to insert objects into a mattress to modify the firmness thereof. however, the specific configuration of the present invention, with all of its inherent advantages, is not shown or taught anywhere in the prior art.

None of the prior art, of which Giese U.S. Pat. No. 1,371,362; Borsini U.S. Pat. No. 3,950,798; Robell U.S. Pat. No. 2,504,352; Cunningham U.S. Pat. No. 3,166,768; and Forwood U.S. Pat. No. 2,651,788 are typical, show or even suggest the overall configuration and the advantages inherently embodied in the features of the present invention.

As illustrated in U.S. Pat. No. 1,371,362 a bed mattress is provided having an outer integral box spring mattress construction made in a rectangular form with a central recess. A center mattress portion is provided with a wooden frame and coil springs to provide central support to a person disposed thereon. The recess is further provided with central wooden slats upon which a central mattress portion is supported. The outer integral border portion is further internally provided with short coils mounted on a raised wooden frame. This teaching, however, does not provide the numerous advantages nor the versatility inherent in the design and configuration of the present invention. For example, unlike this patent, the present invention contemplates the use of numerous different cores which provide a wide range of firmness and support to suit one's particular taste. Moreover, in one embodiment of the present invention, the mattress is also reversible, i.e., the center mattress core portion can be inserted into the mattress from either side, thereby allowing the user to reverse the mattress if so desired.

U.S. Pat. No. 3,950,798 discloses an easily washable and reconstructable mattress provided with a multitude of inserts for insertion inside of a mattress. The invention therein is directed towards replacing the well known woolen mattress with an easily washable mattress, namely, a mattress made of multiple elements each being thrust extruded stuffing elements. However, unlike the present invention, no coil springs supported border portion is provided therein. Additionally, the versatility, in terms of providing diverse degrees of firmness, of the present invention far surpasses that of this reference. The multiple inserts provided in the prior art patent are not of a integral construction, as in the present invention, nor can they provide the same continuous degree of firmness over the entire length of a person's body. By not providing an integral construction, gaps may develop between the stuffing elements of the reference, thereby providing areas of little or no support. Further, there are no provisions made in this patent for the different desires of two or more people sleeping or resting on the same bed.

U.S. Pat. No. 2,504,352 discloses a mattress having differing zones of firmness which are somewhat variable according to the desires of the user. Although this patent discloses the concept of combining different zones of firmness in one mattress, there is no disclosure of a border portion having a recess, or cavity, disposed therein. Further, this patent does not disclose any adaptability of a single mattress to adjust to the different firmness desires of two people sleeping or resting thereon.

U.S. Pat. No. 3,166,768 discloses a mattress substantially supported by interconnected rows of coil springs having three inserts of foam inserted within the mattress, dispersed between the coil springs. Although this patent discloses the use of foam inserts to change the local firmness within the mattress, there is no disclosure of a border portion with a cavity therein or the use of a unitary structure in the form of a mattress core insertable into the mattress to regulate, change or modify the firmness thereof.

U.S. Pat. No. 2,651,788 further discloses a mattress having a mattress cover slidably fastened to the mattress along the central axis of the outermost side of the mattress. The mattress is internally provided with a plurality of coil springs disposed throughout. Resilient foam pads are then disposed directly above the coil springs and below the mattress core as the individual may desire. Although this patent does disclose a mattress cover having differing types of mattresses thereunder, no border portion is disclosed defining a cavity to receive cores through either the top or bottom of the mattress.

SUMMARY OF THE INVENTION

Accordingly, it is one object of the present invention to provide a novel bed mattress which can be modified, in terms of firmness and support, according to the desires of a person supported thereon.

Another object of the present invention is to provide a bed mattress offering a variety of sleeping surfaces which can be adjusted according to the desires of any number of people sleeping or otherwise resting thereon so that each may be independently supported by differing cores of the same mattress.

A further object of the present invention is to provide a mattress which is reversible so that the user may reverse the mattress and insert cores from either the top or bottom as he or she may desire.

Another object of the present invention is to provide a mattress which permits easy demonstration of all the features of the mattress at the point of sale.

A further object is to provide a mattress having increased serviceability, in that any servicing or replacing of the mattress can occur at a place remote from the point of purchase.

Still another object of the present invention is to provide a mattress having an inner core, or cores, said inner core or cores being readily changeable according to the changing desires of the particular user.

A still further object of this invention is to provide a mattress wherein as part of the preservation and care thereof only the core or cores need to be turned over rather than turning the entire mattress, which procedure in the past has always been somewhat tedious and cumbersome.

Yet, another object of the present invention is to provide a bed having a removable core therein, and further readily adapted to receiving a bed board for orthopedic purposes.

Still another object of this invention is to provide a mattress having an inner core or cores, said inner core or cores being readily changeable and wherein said cores are covered with a removable and reversible pillow top.

These and other objects are achieved herein by providing a bed mattress, which may be reversible, having a border portion which defines a periphery of an inner cavity adapted to receive at least one core mattress therein. The border portion has a pillow top, adapted to be reversible, slidably fastened thereto.

BRIEF DESCRIPTION OF THE DRAWINGS

The foregoing and other objects, advantages and characterizing features of the inventive process and apparatus herein described will become more readily apparent from the following detailed description of preferred embodiments thereof, taken in conjunction with the accompanying drawings wherein like reference numerals denote similar parts throughout the various views and in which.

DETAILED DESCRIPTION OF THE PREFERRED EMBODIMENTS

Figure 1A:
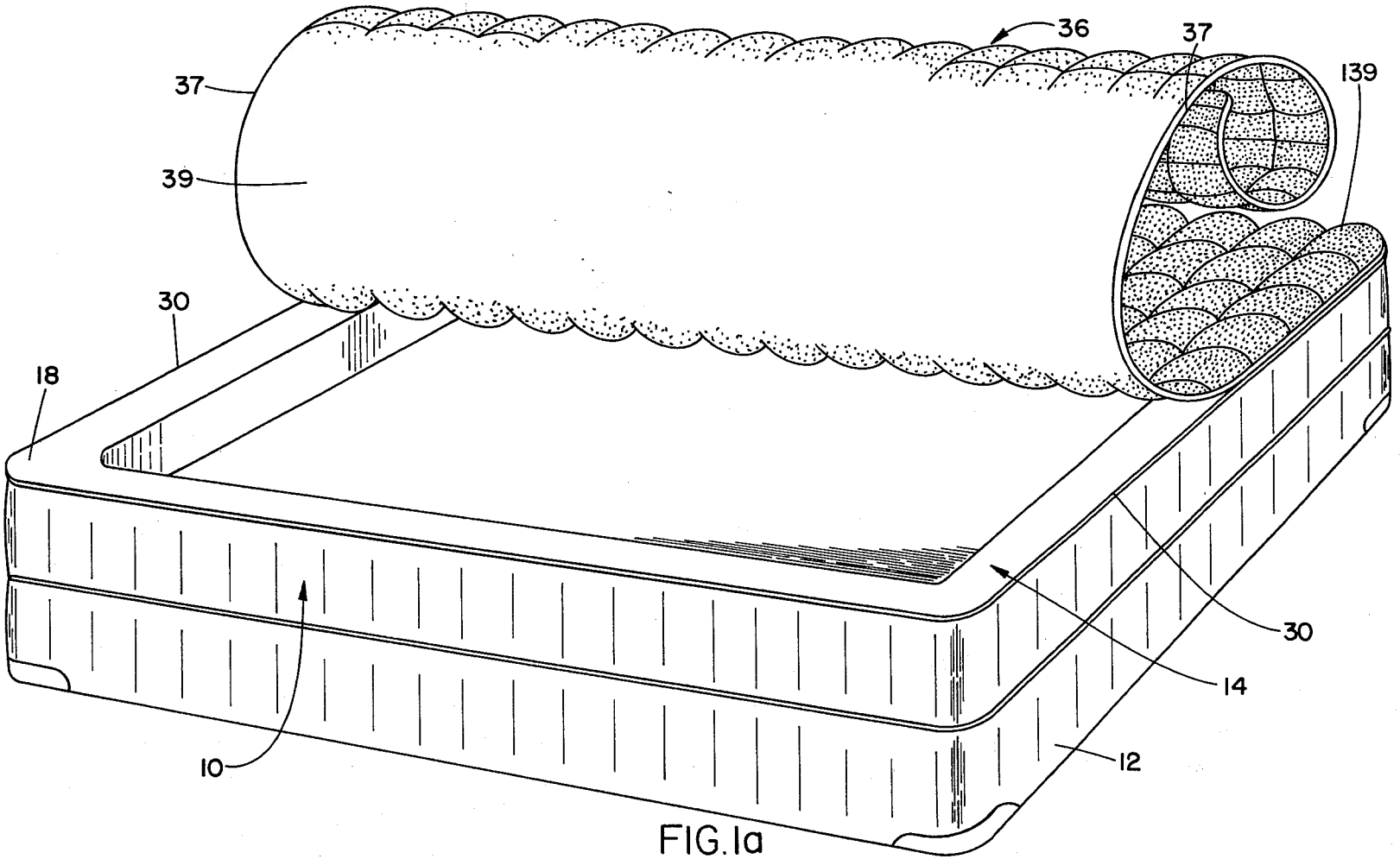
FIGS. 1*a* and 1*b* are perspective views of the mattress according to the present invention, showing a reversible pillow top.
Figure 1B:
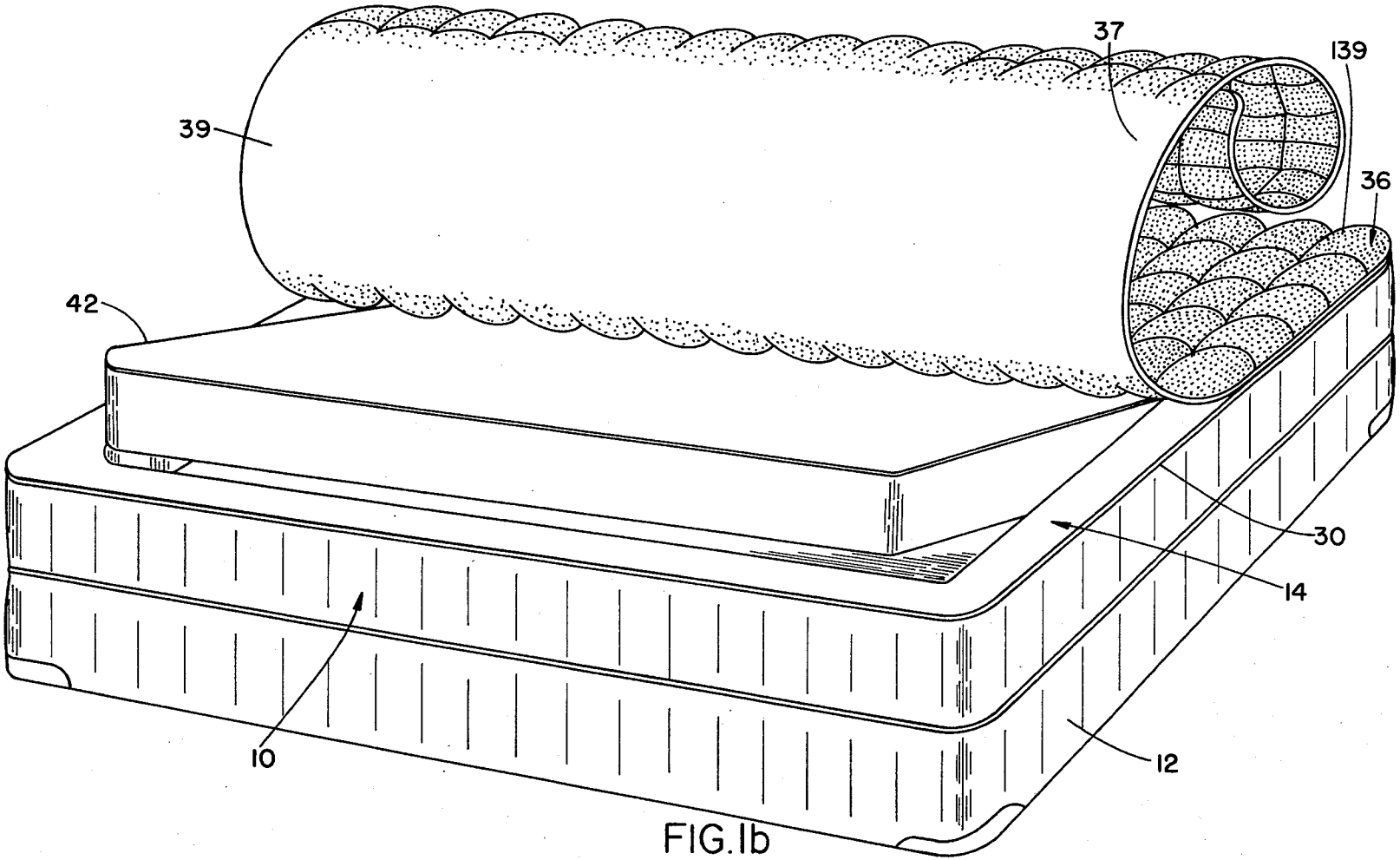
Figure 1C:
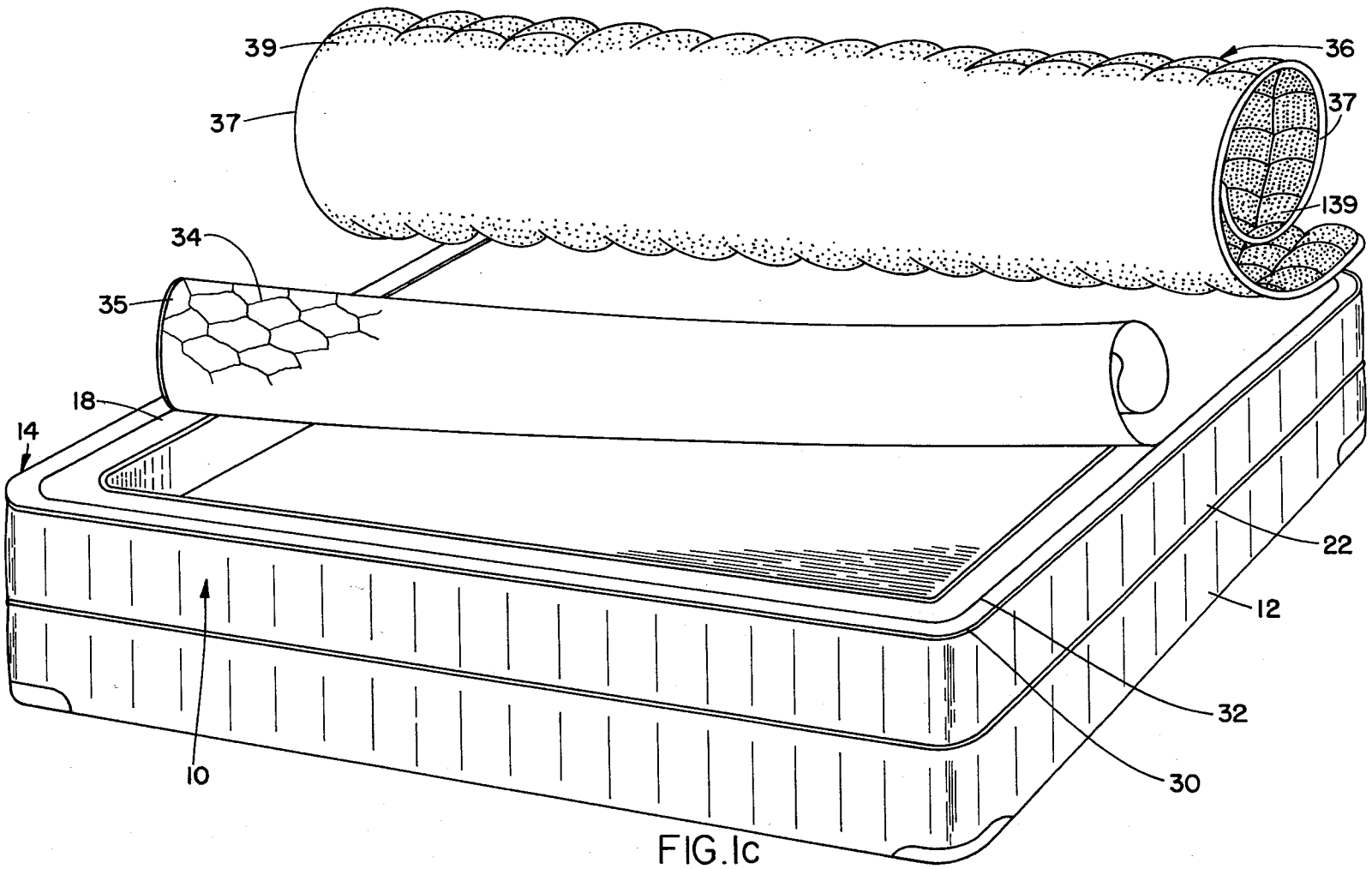
FIG. 1*c* is a perspective view of the mattress having a linear attached thereto.

Referring now in detail to the drawings, the present invention contemplates the use of a mattress 10, embodying the features of the present invention, supported on a box spring 12. The mattress 10 is preferably comprised of a continuous border or collar portion 14 having an outer side 16, a top 18, and a bottom 20. A plush fabric upholstery 22, such as mattress ticking, is normally provided about the exterior of the border or collar portion 14. Typically, the plush material 22, consistent with the upholstery of the box spring 12, is provided along the outer side 16. A soft non-stretchable material 24, preferably made of a woven, or non-woven, breathable fabric or a leather or vinyl type material, covers the top 18 and bottom 20 of the border or collar portion 14.

Internally provided in the border portion 14 are at least one, and preferably, at least two rows of coil springs 26, each coil, for example, preferably made of 15 gauge coil wire. Border wires 28, having any suitable cross-section, are provided about the periphery of the border 14 which, in addition to interconnecting the springs within the border, act to hold the springs 26 in substantially spaced relation therein. The wires 28, and the spring coils 26 form a generally rigid but resiliently yieldable rectangular mattress frame adapted to comfortably support the weight of a person sitting on the edge of the mattress while concurrently maintaining the shape of the mattress. The coils and wires may be constituted of metal or of a suitable plastic material which is adapted to simulate or duplicate the physical and resilient properties of the metal.

In a preferred embodiment, the coil springs 26 within collar or border 14 are individually encased or pocketed, preferably in a thermoplastic non-woven material, such as for example, Duon. The coil springs 26 may, for example, be retained within this encasing material, e.g., non-woven material, by a series of welds formed between adjacent coils such as, for example, in accordance with Stumpf U.S. Pat. No. 4,234,983 and U.S. Pat. No. 4,234,984, the disclosures of which are incorporated by reference herein. Coil springs 26 may also be retained within the pocketed material by stitching or other suitable means and, in such embodiment may be encased in virtually any encasing material.

Figure 12:
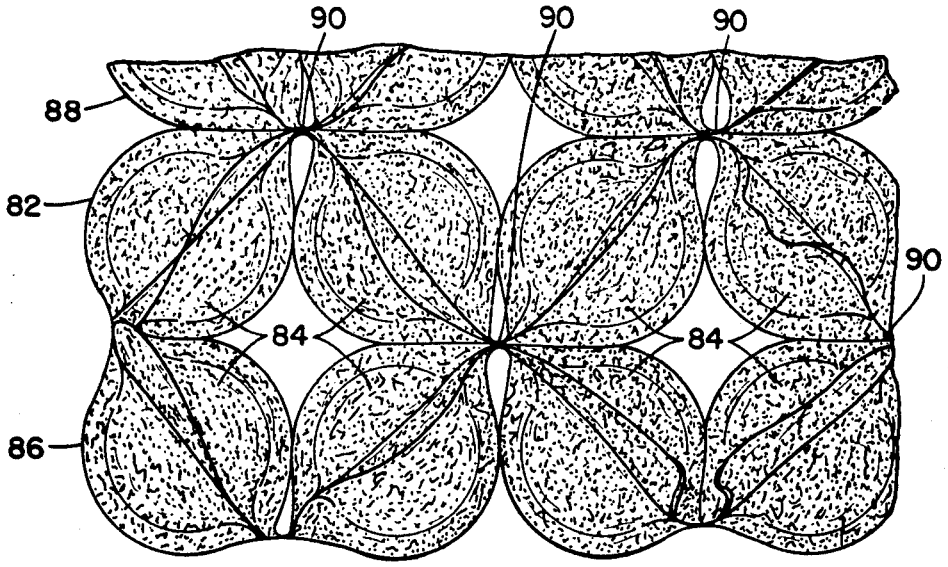
FIG. 12 is an enlarged plan view of a corner face of a rectangular pocketed spring assembly, with the springs disposed in a non-nested square array.
Figure 13:
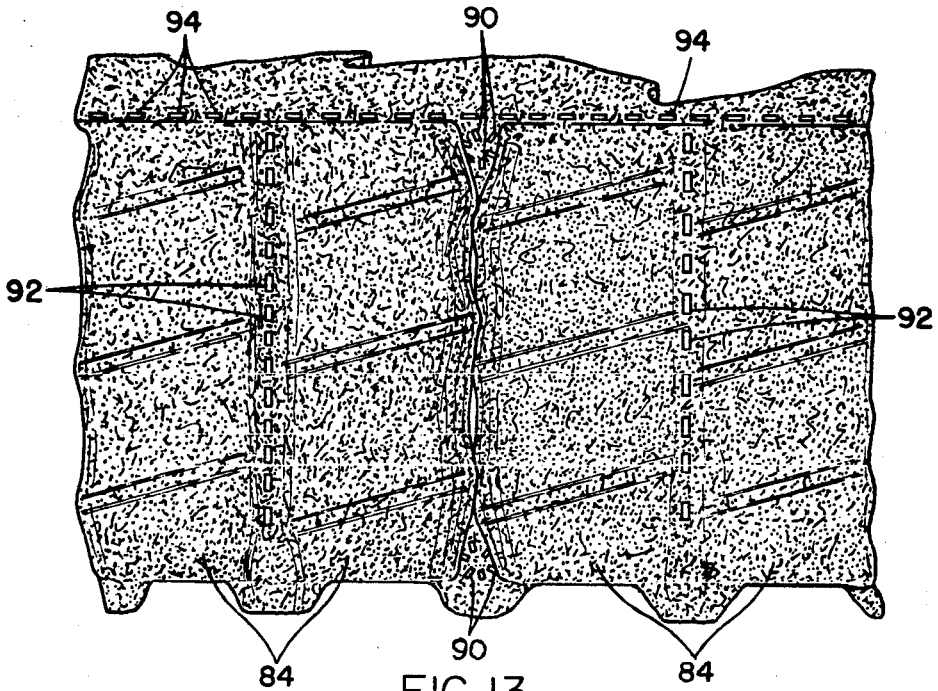
FIG. 13 is a fragmentary elevational view of the assembly of FIG. 12.

In greater detail, in the Stumpf construction which is illustrated in FIGS. 12 and 13, a pocketed spring assembly has a given strip 82 of pocketed springs 84 connected to each adjacent strip 86 and 88 by connecting the two fabric strips together. Although the overall pattern of the assembly may tend to initially confuse the eye, reference should be made to fragmentary enlargements of FIGS. 12 and 13, from which it is more readily apparent that the connections 90 of a given strip of springs to its neighboring strip are made between a pair of successive springs 84 of each strip, and are alternated along any given strip, e.g., strip 82, so that the given strip is connected first to the neighboring strip on one side, e.g., strip 86, and then to the neighboring strip on the opposite side, e.g., strip 88, and so forth, along the entire given strip from one end or side of the assembly to the other. The interstrip connections 90 are conveniently, although not necessarily, made near the opposite faces of the spring assembly, where, because of the preferred barrel shape of the coil, the slack of the fabric between successive pockets near the ends of the coils facilitates the insertion of a tool appropriate to make the connection. As a result of the connection, the pair of coils of each strip immediately adjacent to the interstrip connection 90 are joined with an opposing pair in a configuration which, in plan, resembles a fourleaf clover, each spring pocket being rotated approximately a one-eight turn away from the longitudinal axis of its own strip.

The strips of pocketed coils 88 illustrated herein are produced commercially, and comprise a folded two-ply strip of non-woven fabric of thermoplastic fibers in which the spring pockets are defined between the plies by transverse lines 92 of discrete thermal welds of the plies to one another, and in which the pockets formed in the two-ply strip are closed by a longitudinal seam 94 of similar thermal welds to confine the springs in the pockets. When the springs are permitted to expand after being confined within the pockets, they impose their shapes upon the confining pocket walls in the mid-height of the pockets and produce a ruffle in the flaps of the closing seam, and at the opposite non-seamed end of the spring pocket as well, as the separation of the plies by the expanded spring foreshortens the cloth strip. This results in a slack reach of fabric along the interpocket seam 92 at each end thereof, an effect accentuated somewhat by the barrel shape of the coils 84 specifically illustrated herein.

The divergence of adjacent spring coils 84 at their ends resulting from the barrel shape provides convenient access to the strip material which, in the illustrated instance, is welded to the material of the adjacent strip in the corresponding reaches of fabric between two successive coils of each strip, so that in the presently preferred and illustrated form, the adjacent strips are connected together, as at 90 near the tops and bottoms of the coils, but preferably interiorly of the end convolutions thereof.

The assembly of springs by connecting the strips together, rather than by connecting the springs, as such, to one another, permits each spring to maintain a considerable degree of individual action before requiring the depression of its neighbors in the clover leaf array, and yet, beyond that point, as in areas of concentrated load under the proportinally heavier parts of the body, or when the spring assembly is highly loaded as by bearing the weight of the occupant in sitting position, the clover leaf connection of four springs together in a closely knit group associates them cooperatively so that each can assist the other to regain the full unloaded height permitted by the confining pocket when the concentrated load is subsequently removed.

The pocket material of the preferred assembly is a thermoplastic sheeting, preferably of fibrous material whether or not of continuous filament or staple fiber length, and whether spun and woven, or laid as a non-woven fabric. When the constituent material is thermoplastic, as indicated, the joining technique employed in making the assembly, as well as making the pocketed spring strip itself, may be thermal welding, a localized or spot attachment of adjacent strips being made at or near the end convolutions of the springs along the seam between adjacent pockets in that relatively slack reach of the pocket material provided by the diverging outlines of the barrel-shaped spring coils resulting from the smaller diameter of their respective end convolutions. These connections can readily be made with available welding equipment, and do not appear to interfere materially with compression of the springs individually throughout a substantial portion of their respective heights.

Based upon the considerable history of manufacture of pocketed spring coil assemblies wherein the pocket materials were of spun and woven staple fibers of natural origin, the specific mode of attachment of adjacent strips to one another in accordance with the construction may be something specifically different from thermal welding, the ultimate objective being the secure, reliable, and non-destructive attachment of the adjacent strips to one another. This may, for example, take the form of stitching, or twine ties, or metal fasteners such as hogrings, staples, or the like, or an adhesive capable of adequately penetrating the four plies of a textile fabric with or without heat and pressure. It is to be additionally understood that the border or collar portion 14 can be capable of disassembly to enhance its shipment capability.

Figure 14:
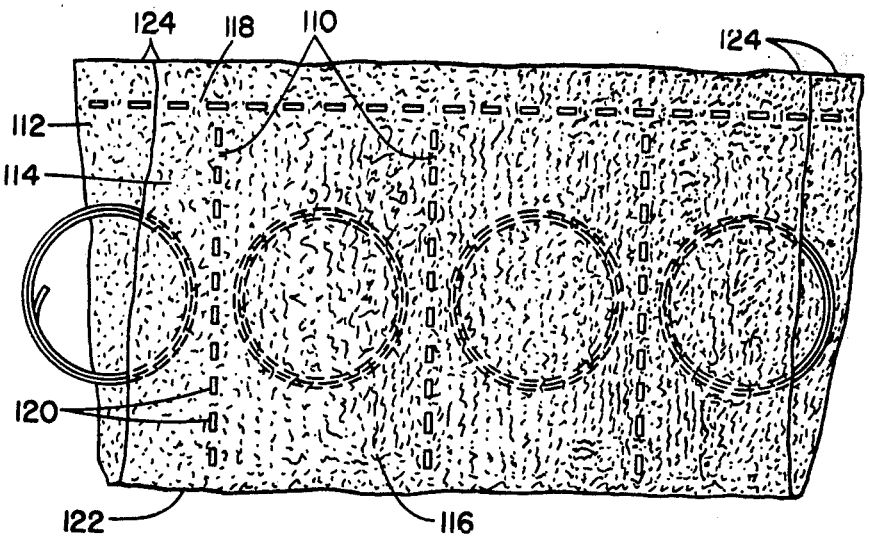
FIG. 14 is an enlarged plan view of a series of pocketed springs.
Figure 15:
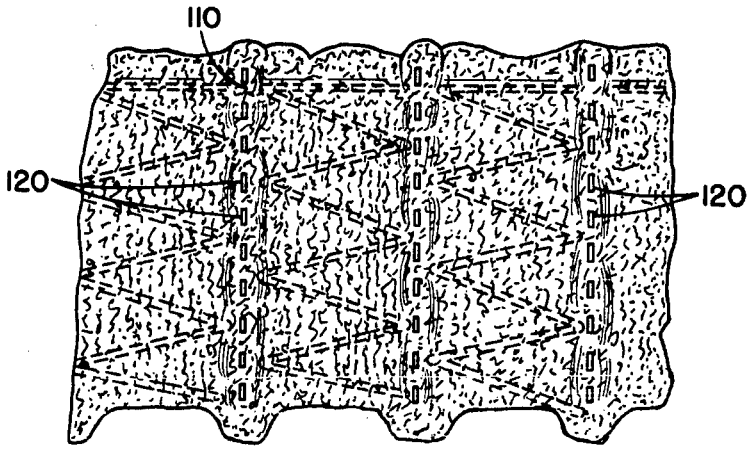
FIG. 15 is a fragmentary elevational view of the springs of FIG. 14.

Similarly, border portion 14 herein may contain non-nested pocketed upholstery springs assembled in accordance with Stumpf U.S. Pat. No. 4,234,983 as illustrated in FIGS. 14 and 15, wherein the transverse lines of attachment 110 of the overlaid plies 112 and 114 of the strip 116 to each other to define the spring pockets, as well as the line 118 of attachment which closes the pockets along the side edges of the plies between which the spring was inserted, are formed of discrete individual welds 120 rather than as a continuous weld. It will also be observed that, as illustrated, the individual welds 120 are spaced apart within the line by a distance approximately equal to the length of the individual welds along the line, and, further, that the welds at each end of the transverse lines 110 of welds between the pockets do not intercept either the folded edge 122 of the fabric strip 116 or its overlaid edges 124 between which the spring was inserted.

With an interrupted line of thermal welds and using nonwoven polypropylene fabric earlier referred to, a line of interrupted welds each a quarter-inch long and approximately one-eight inch wide and separated from each other by approximately one-quarter inch in the line, exhibits over forty percent (40%) greater resistance to separation of the pocket-forming plies than the identical material sewed on production equipment for the manufacture of pocketed springs by the conventional stitching method, using thread which is conventional for the single-thread interpocket stitching, viz., Number 30-3 soft cotton.

While thermal welding in the prescribed pattern may be achieved in a variety of ways, including contact heating and high frequency welding, the ultrasonic welding technique appears to be especially suitable in that the internal induction of heat by its mechanical working of the material is faster than contact heating, and more controllable as well as less dangerous than high-frequency electrostatic methods. Moreover, within limits, any desired pattern of welding can be achieved ultrasonically in this context by suitable modification or the anvil against which the material to be welded is pressed by the welding horn.

It is to be understood that the border portion 14 may contain rigid plastic components or foamed plastic cushioning or the like in combination with or in lieu of springs.

In accordance with the invention herein, the border or collar portion 14 is provided with at least one fastening means 30, which may be in the form of a slidable fastener such as a zipper or any other conventional fastening means, such as one adapted to form a hook and loop type fastening arrangement or seam such as the one sold under the trademark of Velcro, disposed continuously along periphery of the border 14. A removable and reversible pillow top 36 is provided, most preferably quilted, having a fastening means 37, as hereinbefore described, at its periphery to matingly engage fastener 30. The mattress pillow top may be filled with down or other soft foam-like material which will impart a particularly full and luxurient look and texture to the mattress. The removable pillow top may also be provided with means, such as a flap (not shown) or other means to completely conceal the zipper or fastener 30 and/or 37 from view.

Moreover, the pillow top of the present invention is adapted to be completely reversible. That is, both surfaces 39 and 139 of the pillow top 36 are adapted so that either surface (39 or 139) can be used as the top surface. In harmony therewith, the same or different patterns, colors and/or quilting may be utilized for the pillow top surfaces. Furthermore, fastening means 30 and 37 are also so adapted to provide the ready reversibility and fastening of the pillow top. Concomitant with this feature of reversibility, the pillow top may be constructed so as to provide one disposed thereon with varying degrees of firmnesses, plushness, support and the like depending upon the surface of the pillow top which is being used as the top surface. This versatility of comfort may be accomplished, for example, by constructing the pillow top of distinct lamina of varying thickness of foam padding and/or filling, such as down.

Thus, in accordance with the present invention, the removable and reversible pillow top 36 herein provides further support and comfort to a person disposed thereon, especially when it is provided with plush padding. It is, of course, understood that the thickness and thus the firmness of the pillow top may be varied by providing more or less padding, or filling, for example, within the lamina or the pillow top 36. In this manner, due to its removable and reversible feature, one can either replace one pillow top with another of different firmness to provide and achieve a different sleeping surface or simply reverse, i.e., flip, the pillow top to provide the same effect. Furthermore, this feature permits ready refreshing of the mattress 10 by simple placement of a soiled or worn pillow top with a new one or by merely reversing the pillow top so that the unsoiled or unworn surface is exposed and the soiled and worn surface becomes hidden.

In another embodiment of the present invention, a fastening means 30, again preferably in the form of a zipper, may be similarly disposed along the periphery of the bottom 20 of the border portion 14 for purposes of matingly engaging a similar fastening means 37 along the periphery of a further removable and reversible pillow top thereby rendering even further reversibility to the mattress construction. In a further embodiment herein, a liner 34 may also be provided with a fastening means 35, as hereinbefore described, at the periphery thereof. In this case, border portion 14 is provided with a further fastening means 32, which is also disposed continuously along the top 18 in order to matingly engage the fastener 35. It is to be understood that the liner 34 need not necessarily fully cover the center cavity. That is, the liner 34 may only cover the interface between the border 14 and any core within the center cavity. Such an embodiment offers inherent advantages in that it permits accessibility to the center cavity which allows ready access to the cores as well as providing a smooth transition between the border portion 14 and any core which may be positioned in the center cavity. In such an embodiment, the liner 34 may also be permanently, rather than removably, affixed to the border or collar portion 14.

Figure 3:
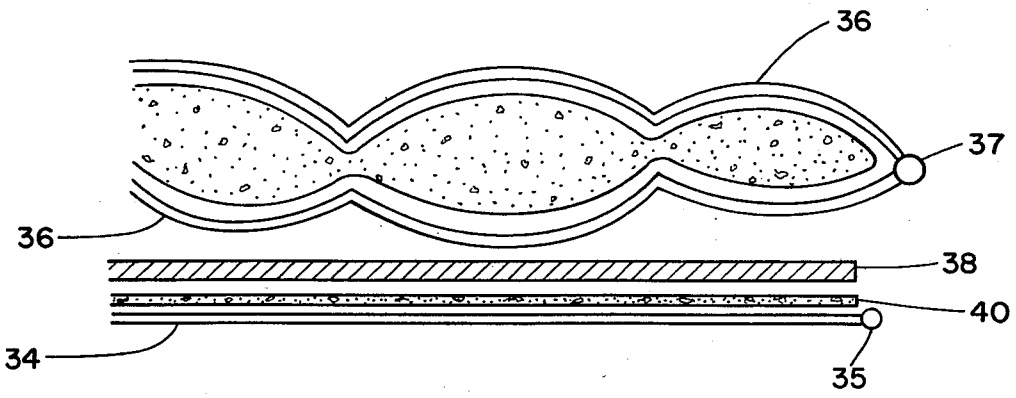
FIG. 3 is a side view, in cross-section, of the pillow top and liner configuration of the present invention.

In other embodiments contemplated herein, a heater panel 38 and/or a thin, high density foam pad 40 may be provided and are normally held between the liner 34 and the pillow top 36 as shown in FIG. 3. Additionally, if desired, the mattress arrangement of the present invention may incorporate suitable heating devices; air circulation devices for heating or cooling or the like, which may be suitably held in place by the removable pillow top of the present invention.

Within mattress 10, the border portion 14 and pillow top 36 define a cavity therebetween. The cavity is centrally located and is configured to receive at least one mattress core 42 which can have a configuration and construction of wide variety. As illustrated herein, the mattress core or cores 42 are normally of integral construction and are preferably configured to be snugly received by, and completely fill the cavity within the mattress 10.

In certain instances, so as to impart to the mattress arrangement a still fuller and more luxuriant look, a unitary piece of foamed material or sponge-like rubber material may also be inserted in the cavity preferably beneath the mattress core. This will cause the center position of the mattress to arc upwardly into a dome appearance, generally referred to as "loft", thereby creating an especially attractive and expensive appearing mattress.

Figure 1D:
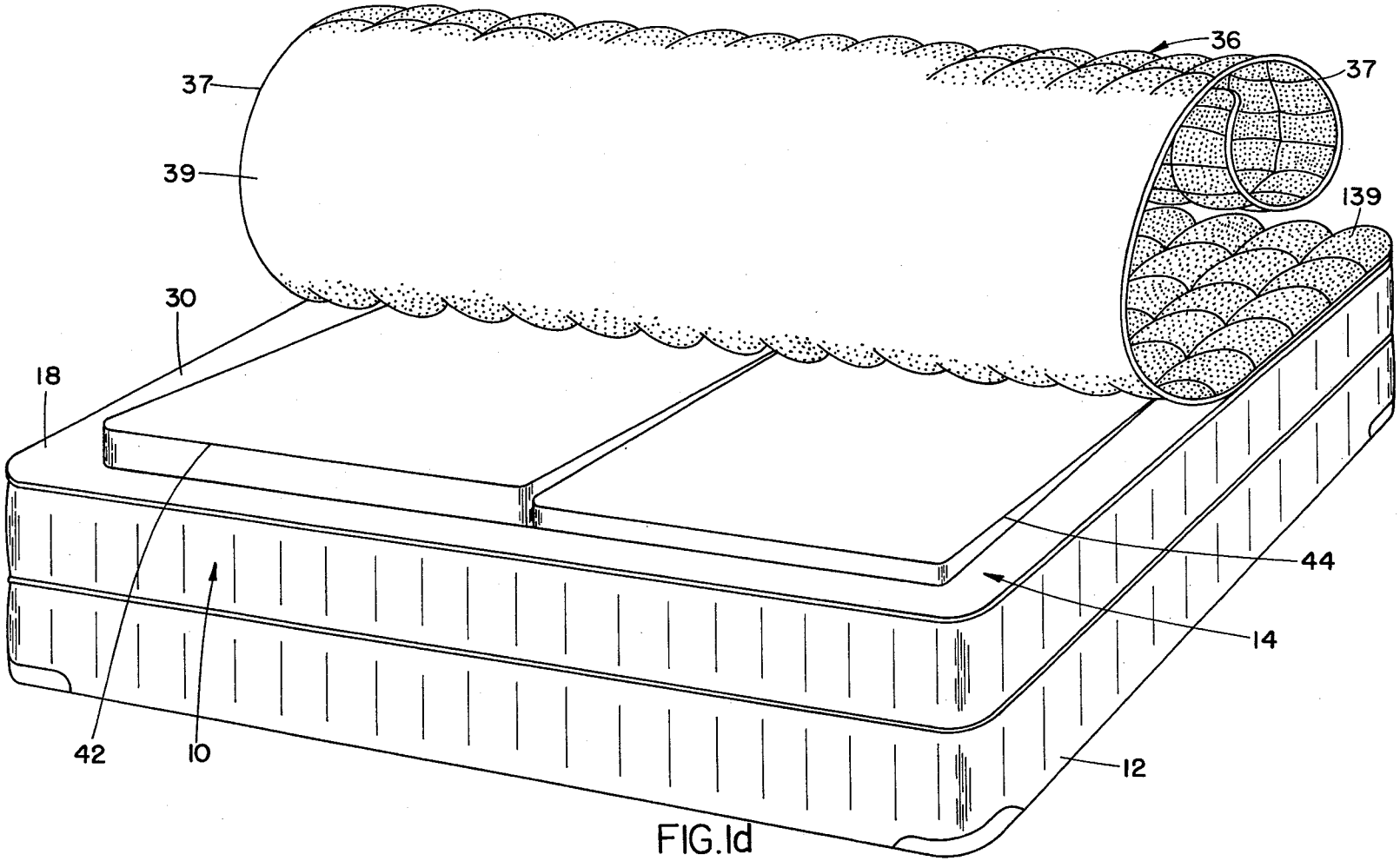
FIG. 1*d* is a perspective view of the mattress according to the present invention utilizing a reversible pillow top and showing the insertion of two separate cores side-by-side.
Figure 2:
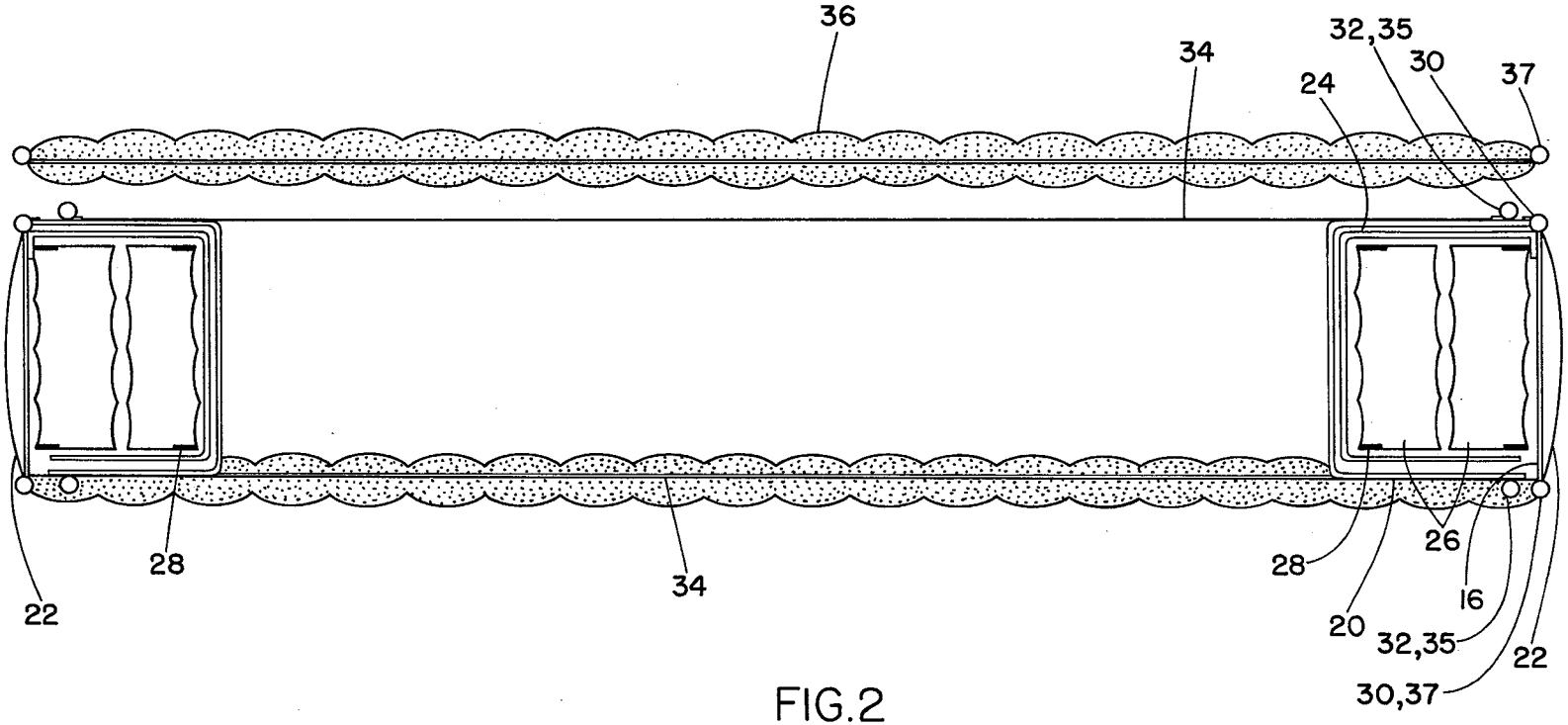
FIG. 2 is a side view, in cross-section, of the present invention without the core inserted therein.
Figure 6:
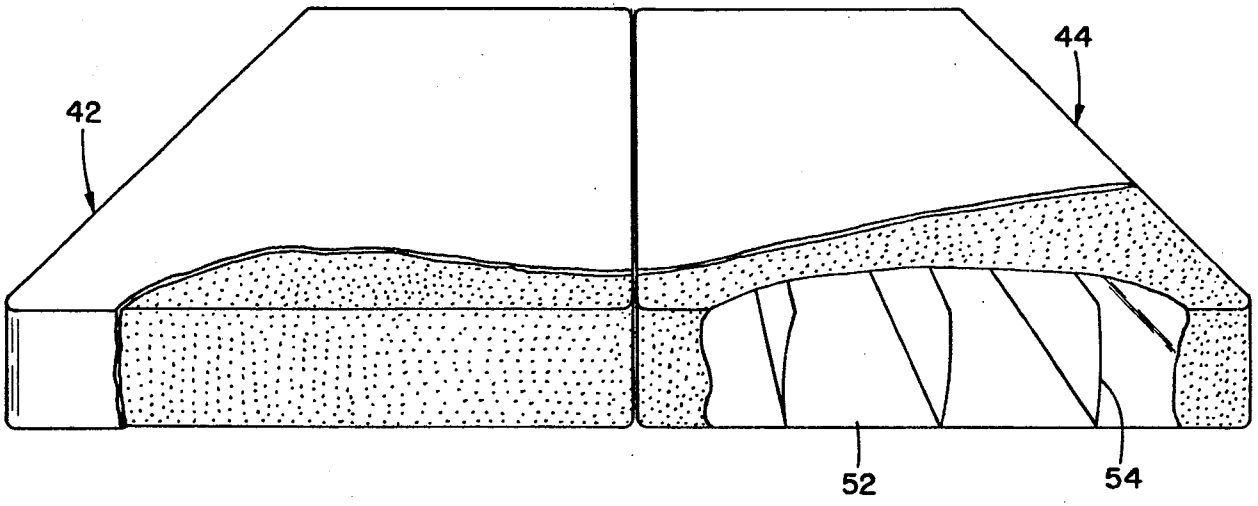
FIGS. 6, 8, 9 and 10 are perspective views, with portions broken away, of two typical cores insertable within a single mattress.

In an illustrative embodiment as shown in FIG. 6, two cores 42, 44 each of differing degrees of firmness, can be inserted side-by-side (as, for example, illustrated in FIG. 1*d*) and held within the cavity thereby adapting the mattress's firmness to allow two people, having different predispositions in regard to firmness, to sleep on the same bed.

Figure 4:
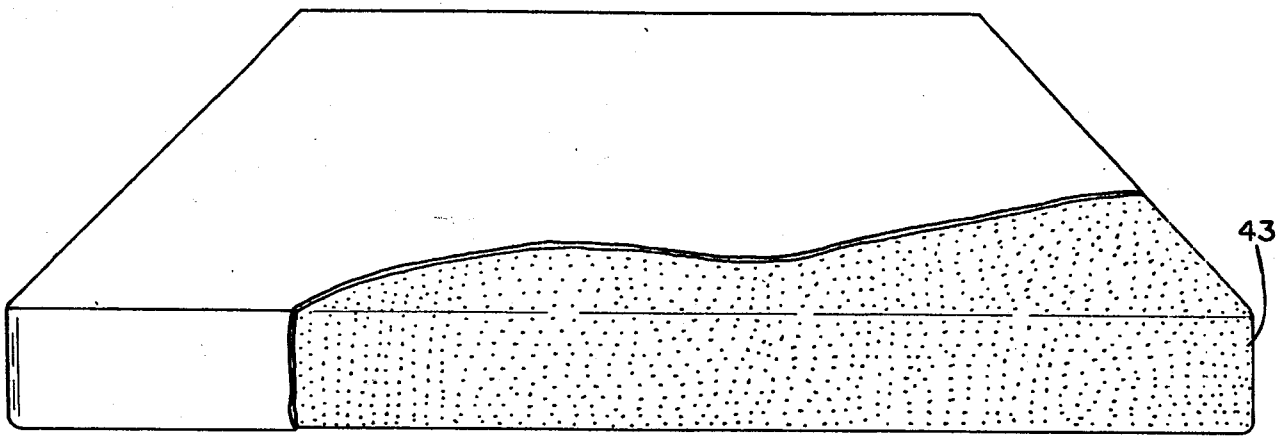
FIGS. 4, 5 and 7 are perspective views, with portions broken away, of typical cores utilized in the present invention.
Figure 5:
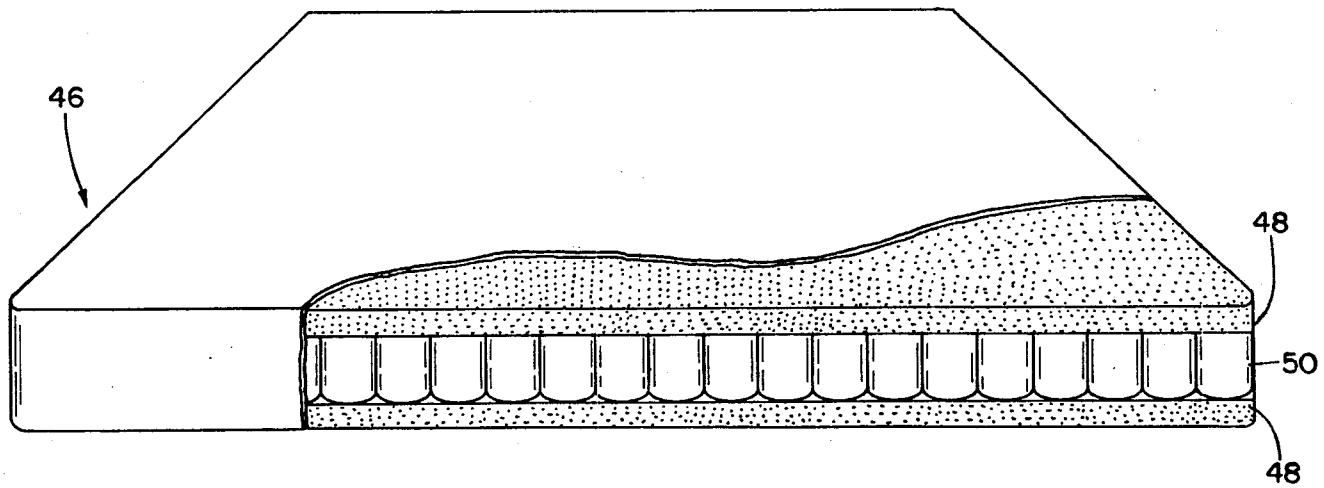
Figure 7:
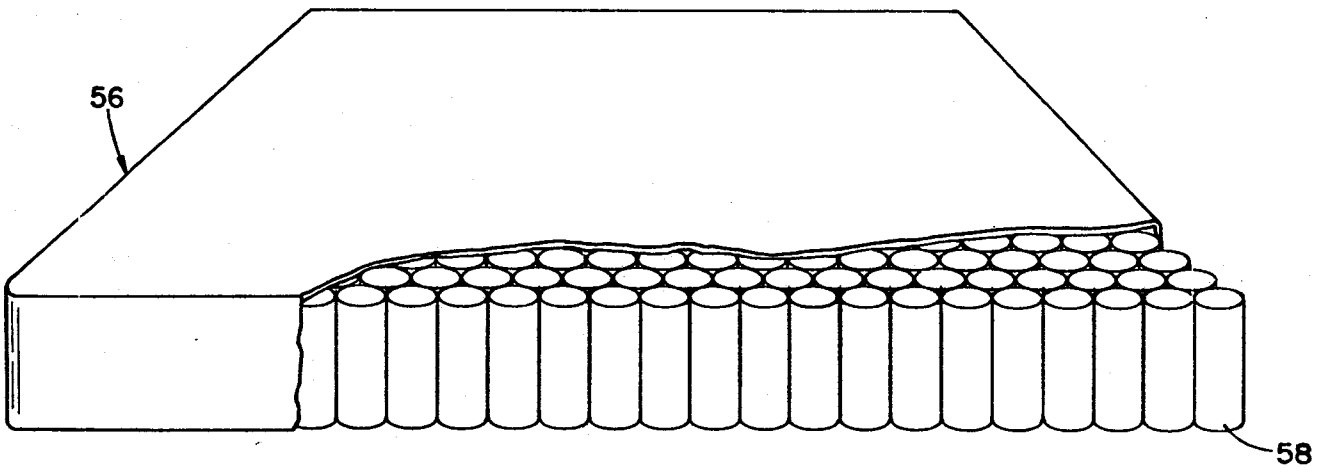
Figure 8:
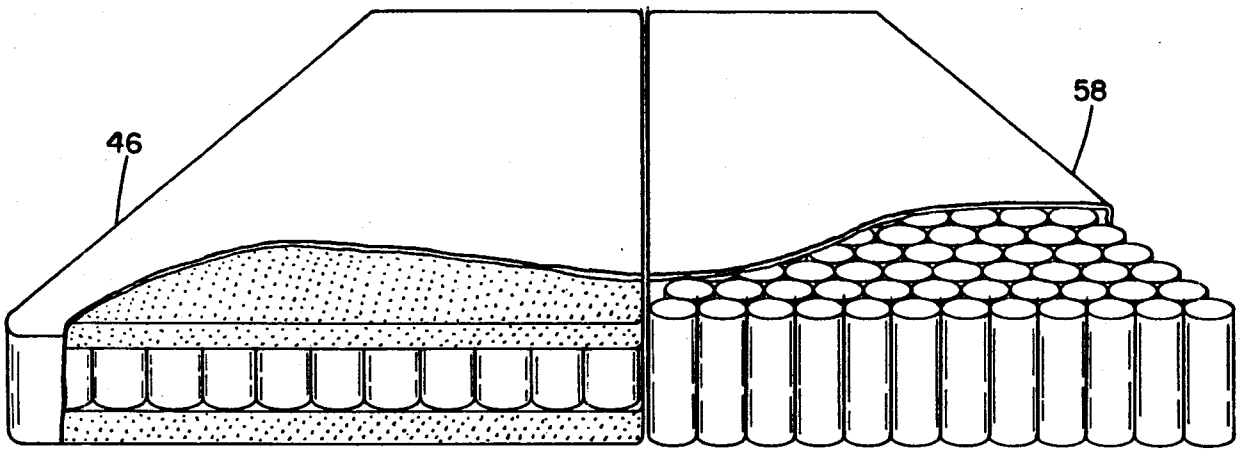
Figure 9:
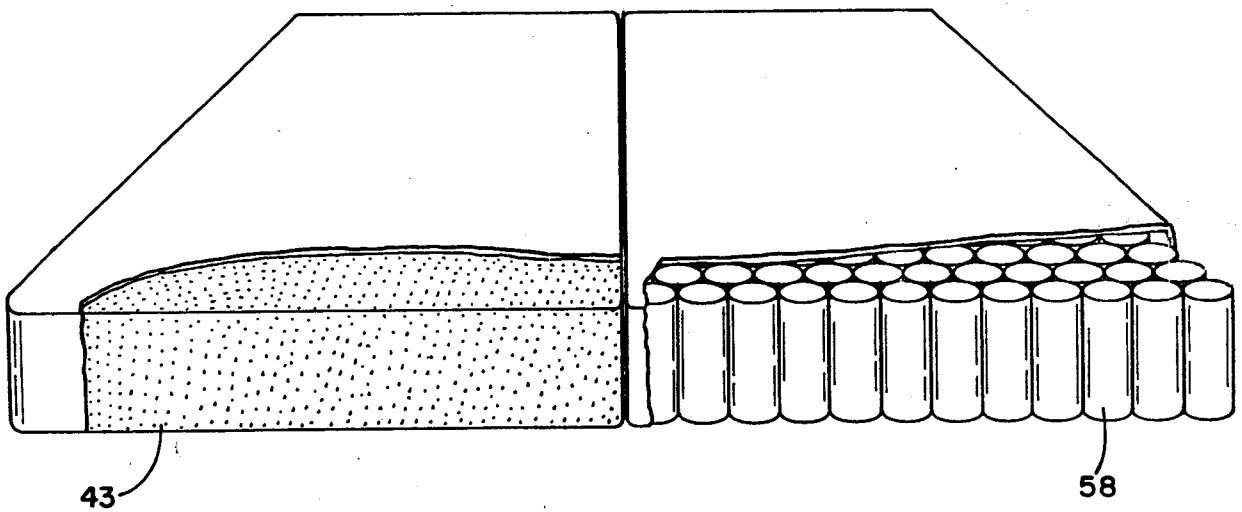
Figure 10:
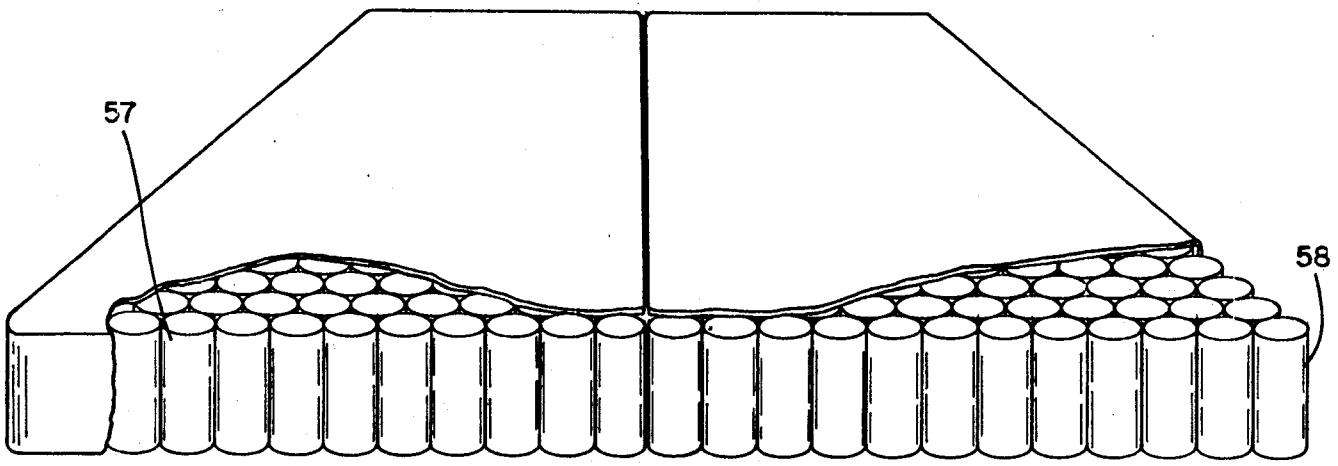
Figure 11:
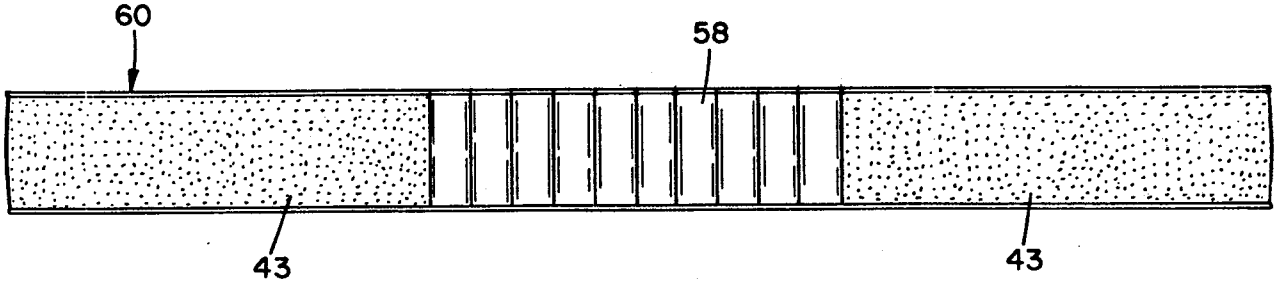
FIG. 11 is a side sectional view of a core having three differing sections therein.

As examples of the different types of mattress cores, which are contemplated by the present invention, FIG. 4 shows a mattress core which consists entirely of solid polyurethane foam 43. FIG. 5, illustrates a core 46, having outer foam pads 48 with a layer of short coils 50 disposed therebetween and along the midsection thereof. FIG. 6, as mentioned previously, describes an air mattress core 44 which includes an outer, generally imperforate, vinyl bladder 52 and a plurality of vinyl support walls 54 longitudinally disposed therein with air entrapped between the walls 54 to provide a strong rectangular configuration thereto. FIG. 7 illustrates a core 56 having a layer of full spring coils 58 disposed therein. FIG. 8 illustrates two cores 46 and 58, both of which may be simultaneously inserted side-by-side into the cavity thereby providing differing degrees of firmness for two individuals. FIGS. 9 and 10 also illustrate another combination of two different cores which can be inserted into the cavity. FIG. 10 shows full coils 57 and 58, the former being made of a lighter metal gauge than the latter. Finally, FIG. 11 shows a tri-core 60 having foam ends 43 with a group of coils 58 disposed therebetween. It should be understood that any combination of cores is contemplated and that the present invention should not be limited to the specific examples shown in the drawings. It should be appreciated that the mattress of the present invention permits one to, in essence, construct the mattress of one's choice by the insertion of different cores and the use of different pillow tops 36. In this manner, a couple may construct a mattress which includes a foam core for one sleeper and a firm, pocketed spring coil for the other. In the event that a sleeper's preference should change at a later date, all that would be required to be changed would be one particular core rather than the entire mattress.

The coils found within the cores of FIGS. 5, and 7 through 11 may, in a particularly preferred embodiment, consist of a rectangular or the so-called "square" array or arrangements of non-nested pocketed spring coils as illustrated, for example, in FIGS. 12–15. The coils found within the cores of FIGS. 5, and 7 through 11 may, in a particularly preferred embodiment, consist of a rectangular or the so-called "square" array or arrangement of non-nested pocketed spring coils as illustrated, for example, in FIGS. 12–15. Thus the coils used therein may be of the type used in the border portion or of any type which effectively provides support to a person resting thereon.

In operation, of the bed mattress of the present invention, a user merely unfastens the reversible pillow top 36 either from the top 18 or bottom 20 of the border portion 14. The user then selects one or more appropriate cores 42, in terms of firmness or support, and inserts the one or more cores within the cavity as defined by the border portion. The pillow top 36 is re-fastened, utilizing either side or surface of the pillow top as the top surface, and the mattress is ready to support a person or persons, thereon.

From the foregoing, it is apparent that the objects of the present invention have been fully accomplished. As a result of the present invention, a novel bed mattress having a core received therein has been provided. Although a preferred embodiment of the principles of this invention has been described and illustrated in detail herein, it should be realized that the same are not limited to the particular configuration shown in the drawings, and that modifications thereof are contemplated and can be made without departing from the broad spirit and scope of this invention as defined in the appended claims.

What is claimed is:

1. A mattress comprising a border portion having a top, bottom and outer side, said border portion extending in a continuous configuration and further comprising a plurality of coil springs, said coil springs transversely extending the entire height of said border portion and having an individually pocketed configuration; said border portion defining a periphery of a cavity disposed therein; at least one mattress core receptably received with said cavity and comprising a plurality of spring coils placed therein, each of said coils being individually enveloped with a pocketing material to form a plurality of pocketed coils; said mattress further comprising a removable pillow top having differing physical characteristics on the opposite surfaces thereof, said pillow top having slideable fastener means for removably and reversibly fastening said pillow top along the periphery thereof to the top of said border portion along the outer periphery of said border portion of the mattress.

2. A mattress as defined in claim 1, said core coils comprising a non-nested configuration.

3. A mattress as defined in claim 1, said core coils having material individually encasing each said coil, said material being ultrasonically welded for interlinking said core coils.

4. A mattress arrangement comprising a mattress body; a removable pillow top having quilted top and bottom surfaces being fastened onto said mattress body and being coextensive therewith so as to cover the entire surface of said mattress body, said pillow top having opposite surfaces providing different comfort levels or support depending upon the surface which is exposed to a user of the mattress; and slidable fastener means for removably and reversibly fastening said pillow top to said mattress body so as to facilitate reversing of said pillow top to selectively provide a different sleeping surface to the user.

5. A mattress arrangement as defined in claim 4, comprising a border portion having a top, bottom and an outer side, and extending in a continuous configuration; coil springs in said border portion defining the periphery of a cavity for receiving said mattress body.

6. A mattress arrangement as defined in claim 5, said coil springs comprising pocketed coil springs.

7. A mattress arrangement as defined in claim 6, said pocketed coil springs comprising non-nested coil springs.

8. A mattress arrangement as defined in claim 6, said pocketed coil springs being interconnected through ultrasonic welding of the material housing said coil springs.

9. A mattress arrangement as defined in claim 5, said border portion being encased in an upholstery, said upholstery comprising a substantially plush material along said outer side of said border portion, said bottom and top sides thereof having upholstery of a generally soft non-stretchable material.

10. A mattress arrangement as defined in claim 9, said generally soft material comprising breathable fabric.

11. A mattress arrangement as defined in claim 5, said mattress further comprising a liner releasably fastened to said border portion in spaced relation between said border portion and said pillow top.

12. A mattress arrangement as defined in claim 11, said mattress further comprising a heater panel secured in juxtaposition to said pillow top.

13. A mattress arrangement as defined in claim 4, said pillow top further comprising means for concealing said fastening means.

14. A mattress arrangement as defined in claim 4, said mattress body including at least one mattress core comprising a foam pad having a layer of short coils placed therein, said short coils being disposed throughout the midsection of said pad.

15. A mattress arrangement as defined in claim 4, said mattress body including at least one mattress core having a plurality of coil springs.

16. A mattress arrangement as defined in claim 4, said mattress body including at least one mattress core of solid foam.

17. A mattress arrangement as defined in claim 4, said mattress body including at least one mattress core comprising at least three portions independently disposed, at least two outer foam pads, with said third portion positioned therebetween having coils therein.

18. A mattress arrangement as defined in claim 4, said mattress body including at least one mattress core comprising an air core, said air core comprised of a hollow outer shell having supporting walls spaced therein, said walls separated by pockets of air.

* * * * *